United States Patent [19]

Thomas et al.

[11] 4,101,800

[45] Jul. 18, 1978

[54] CONTROLLED-POROSITY DISPENSER CATHODE

[75] Inventors: Richard E. Thomas, Riverdale, Md.; Titus Pankey, Jr., Washington, D.C.

[73] Assignee: The United States of America as represented by the Secretary of the Navy, Washington, D.C.

[21] Appl. No.: 813,389

[22] Filed: Jul. 6, 1977

[51] Int. Cl.[2] ..... H01J 1/14; H01J 19/06

[52] U.S. Cl. ..... 313/346 DC; 313/346 R

[58] Field of Search ..... 313/346 DC, 346 R

[56] References Cited

U.S. PATENT DOCUMENTS

| | | | |
|---|---|---|---|
| 2,864,028 | 12/1958 | Coppola | 313/346 R |
| 3,113,246 | 12/1963 | Lemmens et al. | 313/346 DC X |
| 4,019,081 | 4/1977 | Buxbaum et al. | 313/346 R |

*Primary Examiner*—Alfred E. Smith
*Assistant Examiner*—Charles F. Roberts
*Attorney, Agent, or Firm*—R. S. Sciascia; Philip Schneider

[57] ABSTRACT

An emissive member for a controlled-porosity, dispenser-type cathode comprising a three-component sandwich consisting of: (1) a supporting disc; (2) a layer of nonsintered alkaline earth material on said disc; and (3) a thin perforated foil on said layer. The foil is made of refractory metal and has a uniform pattern of tiny holes through which the active material of the reservoir migrates to coat the surface of the foil, the foil thus serving as the electron-emitting surface of the cathode.

8 Claims, 2 Drawing Figures

CONTROLLED-POROSITY DISPENSER CATHODE

BACKGROUND OF THE INVENTION

This invention relates to thermionic cathodes and especially to an improved dispenser-type thermionic cathode.

Dispenser types of thermionic cathodes are usually fabricated by forming a porous metal matrix. The pores of the matrix are filled with an active cathode material, e.g., compounds of alkaline earth metals (Ba, Ca, and Sr), or a reservoir of these compounds is formed behind the matrix. During operation of the cathode, activating materials, e.g., Ba and BaO, are generated within the pores or are supplied from a reservoir behind the matrix. The activating materials must then migrate through the pores, either by surface diffusion or gaseous flow, and be supplied to the emitting surface in sufficient quantities to maintain good surface coverage so as to insure adequate electron emission from the surface.

These matrices are usually formed by compacting a quantity of metal powders of approximately 8 micron size and then sintering the mass at high temperature. (The temperature range depends on the type of metal powder used.) The pressure and temperature are adjusted to give a matrix having the desired pore volume and size. The pore structure (size, total volume, and interconnections) is critical to the proper operation the cathode and the pores in these matrices are very convoluted. If the pores near the back of the matrix (i.e., the side opposite the emitting surface) do not form an interconnecting path with other pores which open upon the emitting surface, cathode life will be shortened since material in those pores cannot reach the surface. An inherently bad feature of such a structure is that, since the connections between pores are randomly generated, the path length that the active materials must traverse to reach the emitting surface can be many times the actual matrix thickness (typical thicknesses are about 1–4 mm). It has been demonstrated that these factors limit the life and emission of conventional dispenser cathodes. Also, since these matrices cannot be examined nondestructively to determine if their pore structure is satisfactory, bad cathodes which will fail prematurely are sometime installed in tubes.

SUMMARY OF THE INVENTION

The advantages of the invention are obtained by use of a thin foil of refractory material having a pattern of tiny, uniform holes therethrough, the foil sitting on a "nonporous" reservoir of nonsintered alkaline earth material which lies between the foil and a backing plug. All of the active material in the reservoir is thus free to migrate through the holes, and the size and spacing of the holes can be controlled for optimum performance. (When used herein, the term "nonporous reservoir" is intended to refer to a quantity of material which does not have the convoluted pore structure of the metallic sintered matrix of the conventional dispenser-type cathode where the alkaline earth material is disposed in tubes or pockets of metal called "pores" which may or may not communicate with each other and with the emitting surface. In a "nonporous reservoir," all of the active material in the reservoir is free to move out to the emitting surface. The alkaline earth material in the reservoir may actually be porous in the usual sense of having minute interstices and being permeable to liquids. When used without quotation marks, the terms porous and pore will be used in their ordinary dictionary sense; when used with quotation marks, these terms will refer to the walled container type of cavity found in sintered metal matrices of the prior art and further described later herein.

Furthermore, when used herein, the term "controlled porosity" refers to controlling the size and spacing of the tiny holes in the metallic foil which provides the emitting surface for the emission member of the cathode.)

DETAILED DESCRIPTION OF THE INVENTION

Figure 1:
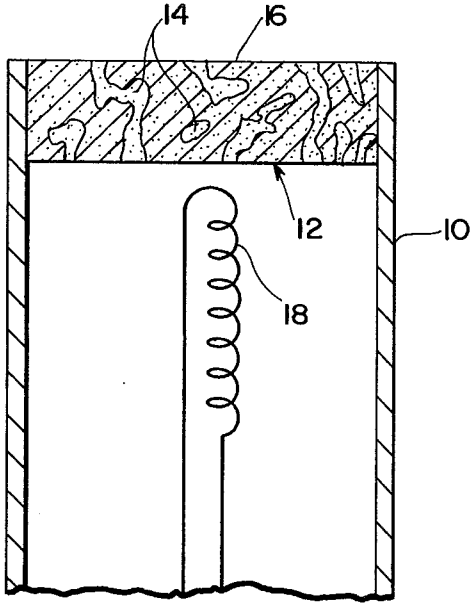
FIG. 1 is a schematic cross-sectional view of dispenser-type cathode of the prior art.

FIG. 1 shows a cross-sectional view of a prior-art cathode of the dispenser-type. The cathode comprises a metal tube 10 supporting, at one end, a cylindrical plug 12 consisting of a sintered "porous" metal matrix. The matrix is generally a pressed and sintered mixture of a refractory metal, such as tungsten, molybdenum, etc., or an alloy of these metals, and alkaline earth materials such as carbonate compounds of barium or strontium. The plug 12 contains "pores" 14 some of which connect with the emitting surface 16 and some of which do not. Upon heating by passing an electric current through a heater element 18, the alkaline earth metals contained in the "pores" 14 migrate through the openings in the "pores" to the surface (at least, through the "pores" which open on, or connect with, the emissive surface) by means of surface diffusion or gaseous flow and spread over the surface. The "pores" in this type of sintered metal matrix are actually walled containers from which the contained material cannot exit except through holes in the walls.

Figure 2:
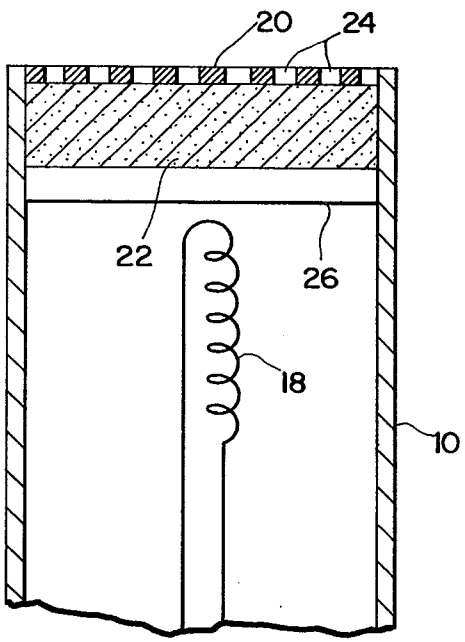
FIG. 2 is a schematic cross-sectional view of a dispenser-type cathode in accordance with the present invention.

The improved cathode of the invention illustrated in FIG. 2 is constructed by utilizing an emissive member comprising an emitting surface consisting of a foil 20, preferably of iridium or iridium-coated metal, disposed on top of a "nonporous" reservoir 22 of alkaline earth compounds which, in turn, is adjacent to and above a backing plug 26 of refractory metal, such as tantalum. The backing plug 26 might also be an existing dispenser-type cathode structure, such as the conventional, alkaline-earth-impregnated, tungsten cathode plug.

The emitting-surface foil 20 can be formed from a refractory metal, such as iridium, tungsten, molybdenum, tantalum, or from combinations of these, or from an iridium-coated refractory metal. The foil 20 is formed with a regular pattern of holes 24, typically 25 microns in diameter spaced 50 microns from each other center-to-center, covering the entire surface area. The holes 24 can be formed in the foil by photolithography, laser drilling, chemical etching techniques, etc, and the hole size and spacing can be varied to obtain optimum cathode performance.

The reservoir 22 is typically a 125-micron-thick layer and comprises a nonsintered, "nonporous" mixture of one or more alkaline earth compounds, such as barium, calcium or strontium carbonates, which produce electron-emitting active materials, such as barium or barium oxide, and one or more chemical reducing agents for the alkaline earths, such as powders of metals such as tantalum, zirconium and the like, which act on the active materials so as to produce greater cathode emission. The metal powder is used in small quantity, generally no more than about 30 percent by volume and, although its use is preferred, its presence is not absolutely necessary to operation of the invention. The reservoir material may, or may not be compressed — it may be compressed if high density is desired. It can be sprayed on the backing plug or simply poured on top of it. The foil is then pressed down on top of the reservoir material.

As compared with a standard impregnated tungsten cathode, the improved cathode has shown at least twice the emission capability at the same temperature or the same emission at 100° C. lower than the temperature of the standard cathode.

Other advantages are:

1. The thinness of the foil minimizes the distance the reservoir material must migrate to reach the emitting surface. Thus, a better supply of active material is provided at the surface. This is in contrast to the long distances that active material must travel through the convoluted "pore" structure characteristic of prior dispenser cathodes.

2. The hole size and spacing are uniform and can be controlled to provide an optimum supply of active material to the surface. This is an advantage over the random pore structure of the standard dispenser cathode.

3. The uniform hole size and spacing also provide an ideal substrate on which to construct an integral control grid structure (in registry with the holes) which can control cathode emission and not hinder diffusion of materials from the reservoir to the surface.

4. This structure provides a known and predictable porosity which can be examined microscopically before use so that tube reliability is improved. The internal "pore" structure of standard dispenser cathodes cannot be examined microscopically before use.

Obviously many modifications and variations of the present invention are possible in light of the above teachings. It is therefore to be understood that within the scope of the appended claims the invention may be practiced otherwise than as specifically described.

What is claimed and desired to be secured by letters patent of the United States is:

1. A thermionic, dispenser-type cathode having an emissive member comprising:

a backing plug;

a "nonporous" reservoir of active cathode material, comprising a quantity of at least one alkaline earth material, adjacent said backing plug; and a foil disposed on the free surface of said reservoir, said foil being formed from at least one refractory metal with a set of uniformly sized and spaced holes therein to permit the active electron-emitting material within said reservoir to migrate through said holes and to spread over the surface of said foil when the reservoir material is heated to the proper temperature.

2. A cathode as in claim 1, wherein said foil is formed from iridium.

3. A cathode as in claim 1, wherein said foil is formed from an iridium-coated refractory metal.

4. A cathode as in claim 1, wherein said reservoir contains a mixture of at least one alkaline earth material and at least one metal powder taken from the group of elements consisting of tantalum and zirconium.

5. A cathode as in claim 1, wherein said reservoir contains a mixture of at least one alkaline earth material and at least one metal powder which is a chemical reducing agent for the alkaline earth material.

6. A cathode as in claim 5, wherein said metal powder is no more than about 30 percent by volume of the mixture.

7. A cathode as in claim 1, wherein said holes in said foil are approximately 25 microns in diameter.

8. A cathode as in claim 7, wherein the centers of said holes are approximately 50 microns apart.

* * * * *